United States Patent [19]

Gerber et al.

[11] 4,451,560

[45] May 29, 1984

[54] CHEMICAL SENSITIZATION OF SILVER HALIDE GRAINS

[75] Inventors: Arthur M. Gerber, Belmont; Judith Loucks, Newton, both of Mass.

[73] Assignee: Polaroid Corporation, Cambridge, Mass.

[21] Appl. No.: 441,687

[22] Filed: Nov. 15, 1982

[51] Int. Cl.[3] ..... G03C 1/28

[52] U.S. Cl. ..... 430/567; 430/568; 430/599; 430/603; 430/605; 430/496; 430/948

[58] Field of Search ..... 430/567, 603, 569, 605, 430/571, 496, 568, 599, 564, 948

[56] References Cited

U.S. PATENT DOCUMENTS

| | | | |
|---|---|---|---|
| 3,206,313 | 9/1965 | Porter et al. | 430/599 |
| 3,888,676 | 6/1975 | Evans | 430/571 |
| 3,989,527 | 11/1976 | Locker | 430/567 |
| 4,035,185 | 7/1977 | Evans et al. | 430/569 |
| 4,301,242 | 11/1981 | Pätzold et al. | 430/567 |
| 4,352,874 | 10/1982 | Land et al. | 430/564 |
| 4,356,257 | 10/1982 | Gerber | 430/568 |

*Primary Examiner*—Won H. Louie, Jr.
*Attorney, Agent, or Firm*—Philip G. Kiely

[57] ABSTRACT

A method for forming a photosensitive element which comprises contacting silver halide in a plurality of spaced depressions in a surface with a mixture of a silver halide solvent and preformed sensitivity centers.

33 Claims, 1 Drawing Figure

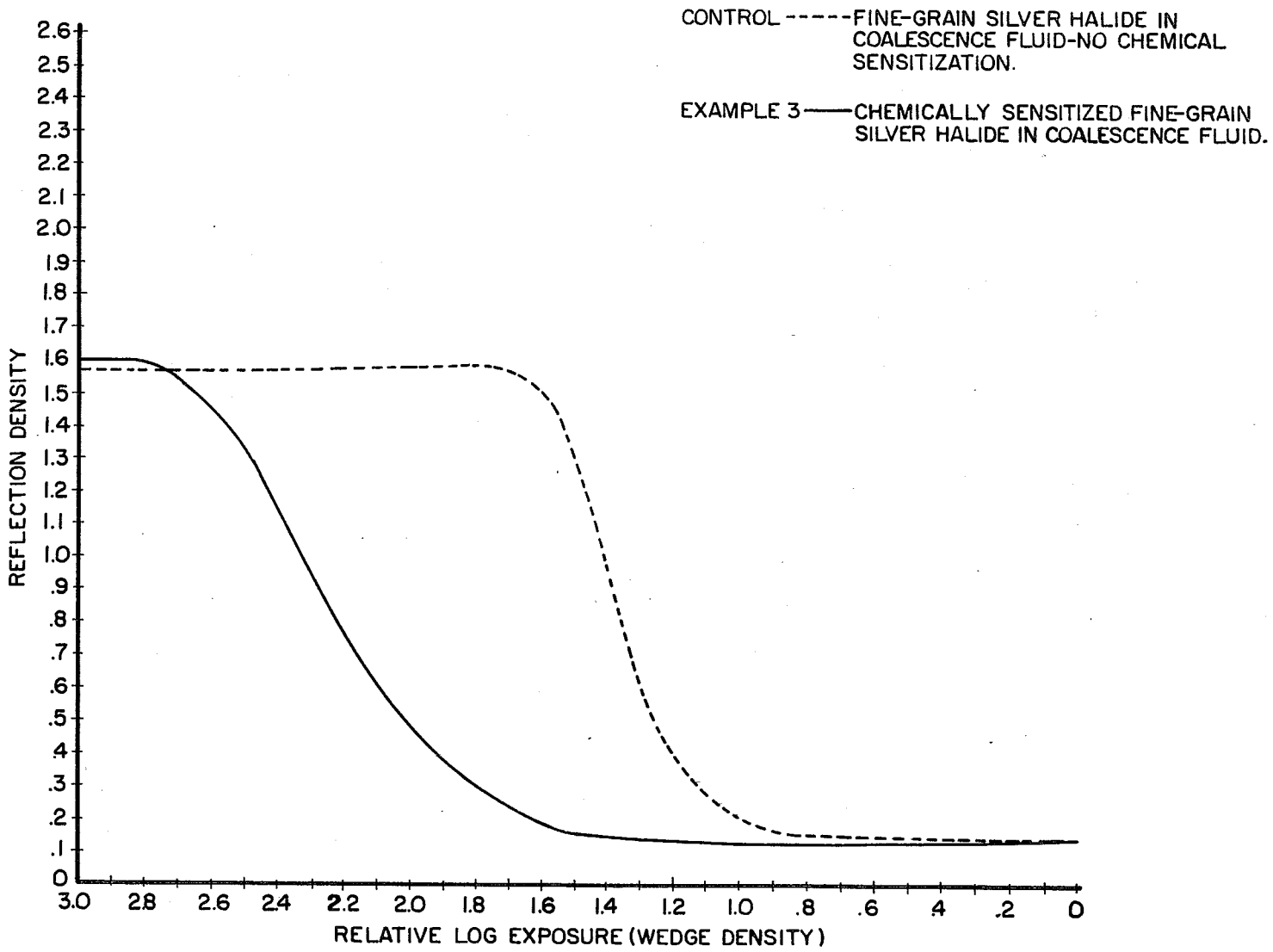
CONTROL -----FINE-GRAIN SILVER HALIDE IN COALESCENCE FLUID-NO CHEMICAL SENSITIZATION.
EXAMPLE 3 ——CHEMICALLY SENSITIZED FINE-GRAIN SILVER HALIDE IN COALESCENCE FLUID.
REFLECTION DENSITY
2.6
2.5
2.4
2.3
2.2
2.1
2.0
1.9
1.8
1.7
1.6
1.5
1.4
1.3
1.2
1.1
1.0
.9
.8
.7
.6
.5
.4
.3
.2
.1
0
3.0
2.8
2.6
2.4
2.2
2.0
1.8
1.6
1.4
1.2
1.0
.8
.6
.4
.2
0
RELATIVE LOG EXPOSURE (WEDGE DENSITY)

CHEMICAL SENSITIZATION OF SILVER HALIDE GRAINS

BACKGROUND OF THE INVENTION

It is known in the art to chemically sensitize silver halide grains. Chemical sensitization provides a chemical entity sometimes known as a sensitivity speck or sensitivity center on the grain. The purpose of chemical sensitization is to produce chemical changes in the silver halide grains so that hey become more responsive to the light they absorb. Chemical sensitization is carried out subsequent to the silver halide grain formation (precipitation) and during what is known as the "digestion" or chemical sensitization phase, wherein one or more chemical sensitizers are added and the emulsion held at elevated temperatures for a specified period of time. A wide variety of materials are known as chemical sensitizers, but the most commonly employed type is sulfur plus gold sensitization.

Copending application of Edwin H. Land, Ser. No. 234,937, filed Feb. 17, 1981, (commonly assigned) now U.S. Pat. No. 4,366,235, issued Dec. 28, 1982, is directed to a method for forming a predetermined, regular geometric spaced array of sites and then forming single effective silver halide grains at said sites. Thus, by forming the sites in a predetermined spatial relationship, if the silver halide grains are formed only at the sites, each of the grains will also be located at a predetermined and substantially uniform distance from the next adjacent grain, without touching the next adjacent grains, and their geometric layout will conform to the original configuration of the sites.

Copending application of Arthur M. Gerber, Ser. No. 298,640, filed Sept. 2, 1981, (common assignee) now U.S. Pat. No. 4,356, 257, issued Oct. 26, 1982, is directed to a method for forming a photosensitive element comprising a plurality of single effective silver halide grains, which method comprises coalescing fine-grain silver halide in a plurality of predetermined, regular, geometric spaced depressions. Preferably, the coalescence is effected by contacting fine-grain silver halide with a solution of a silver halide solvent.

U.S. Pat. No. 4,352,874, issued Oct. 5, 1982 to Edwin H. Land and Vivan K. Walworth is directed to a method of forming a photosensitive element comprising a plurality of single effective silver halide grains, which method comprises coalescing a fine-grain emulsion in a plurality of predetermined spaced depressions by contacting said fine-grain emulsion with a solution of a silver halide solvent containing a dissolved silver salt.

Copending application of Arthur M. Gerber, Warren D. Slafer and Vivian K. Walworth, Ser. No. 298,639 filed Sept. 2, 1981 (common assignee) now U.S. Pat. No. 4,353,977, issued Oct. 12, 1983, discloses and claims a process which employs a cover sheet comprising a hydrophilic layer in contact with the relief pattern during coalescence whereby single effective grains are retained on the hydrophilic layer subsequent to separation from the relief pattern.

Copending application of Vivian K. Walworth Ser. No. 298,637, filed Sept. 2, 1981, now U.S. Pat. No. 4,359,526, issued Nov. 16, 1982, is directed to a method of forming single effective grains by coalescing a fine-grain emulsion in a plurality of spaced depressions to provide a single effective grain in each depression by contacting said fine-grain emulsion with a silver halide solvent in the vapor phase.

Copending application of Arthur M. Gerber Ser. No. 323,936, filed Nov. 23, 1981, now U.S. Pat. No. 4,359,525, issued Nov. 16, 1982, is directed to a method of forming single effective grains by coalescing fine-grain silver halide in a plurality of spaced depressions by melting said fine-grain silver halide.

The above-mentioned copending patent applications disclose the chemical sensitization of the single effective silver halide grains employing solutions of conventional chemical sensitizers. For example, U.S. Pat. No. 4,356,527 application discloses the chemical sensitization of single effective grains formed by coalescence of a fine-grain emulsion by immersion of the thus-formed single effective grains in a solution containing gold thiocyanate complex and sodium thiosulfate.

An improved method for providing chemically sensitized single effective silver halide grains has now been found.

SUMMARY OF THE INVENTION

The present invention is directed to a method for forming a photosensitive element which comprises contacting silver halide in a plurality of spaced depressions in a surface with a mixture of a silver halide solvent and preformed sensitivity centers. In a preferred embodiment, the silver halide in the depressions is coalesced to form a single effective grain in each depression.

BRIEF DESCRIPTION OF THE DRAWING

The FIGURE shows shows H&D curves illustrating the photographic response of photosensitive element of Example 3 compared to a control photosensitive element.

DETAILED DESCRIPTION

The present invention is directed to a method of chemically sensitizing silver halide in a plurality of spaced depressions by contacting said silver halide with a mixture of silver halide solvent and preformed sensitivity centers. Preferably, the chemical sensitization is accomplished by contacting the silver halide in the depressions with a chemically sensitized fine-grain emulsion carrying the preformed sensitivity centers. The silver halide in the depressions may be a plurality of silver halide grains or a single preformed grain deposited in each depression. In one embodiment, the silver halide in the depressions comprise a single effective grain formed by coalescence in each depression, by, for example, the methods set forth U.S. Pat. Nos. 4,356,257; 4,359,526 and 4,359,525. Chemical sensitization may follow coalescence. In a preferred embodiment, coalescence and chemical sensitization are concurrent.

Chemical sensitization by immersion of the silver halide grains in the depressions in a solution of sensitizers requires careful control of temperature, pH, pAg, chemical composition and residence time in the sensitizing solution. Since the preferred method of forming single effective grains by coalescence is by applying a solution of silver halide solvent to a nip formed by a cover sheet and the sheet carrying the fine-grain emulsion in the depressions, it was proposed to add the solution of chemical sensitizer to the coalescing solution. However, with this procedure, optimal chemical sensitization was difficult to achieve.

It has now been found that silver halide in the depressions can be chemically sensitized by contacting said silver halide with a mixture of silver halide solvent and preformed sensitivity centers.

Chemically sensitized single effective grains can be obtained by contacting a fine-grain emulsion in the depressions with a chemically sensitized fine-grain emulsion concurrent with coalescence. Thus, coalescence can be carried out by contacting the fine-grain emulsion in the depressions with a coalescing amount of silver halide solvent and a chemically sensitized fine-grain emulsion. Alternatively, the single effective grains may be contacted subsequent to coalescence with a silver halide solvent and a chemically sensitized fine-grain emulsion. The chemically sensitized fine grains may remain discrete or undergo dissolution prior to contacting the silver halide in the depressions.

In a preferred embodiment, single effective grains are formed by coalescence with the simultaneous chemical sensitization of said grains. Such a procedure eliminates a separate step in the process for forming the grains and provides for more uniform and consistent chemical sensitization, since depletion or contamination of the sensitizing solution does not occur. By means of the present invention a constant concentration and fresh supply of sensitizers is delivered to each of the depressions containing the silver halide.

In the above-described preferred embodiment, the novel method of the present invention comprises adding to the coalescing silver halide solvent solution a conventionally chemically sensitized fine-grain silver halide emulsion and subsequently coalescing an unsensitized fine-grain silver halide emulsion. Preferably, the silver halide solvent solution containing the chemically sensitized fine-grain emulsion is added to the nip formed by the embossed base carrying the fine-grain silver halide in the depressions and a cover sheet and passing said base and cover sheet between laminating rolls.

The fine-grain emulsion deposited in the depressions has a grain size sufficiently small to substantially conform to the contours of the depressions. Preferably, a silver halide emulsion containing grains between about 0.01 and 0.50 μm in diameter is employed. Particularly preferred is a silver halide emulsion having a grain size with an average diameter of about 0.1 μm or less.

The depressions in the embossed base need only be in a spaced array to provide a receptacle for the fine-grain emulsion and so that the single effective grains will not contact each other. In a preferred embodiment, however, the depressions are in a predetermined, regular, geometric spaced array.

Since the silver halide grains must be kept in suspension prior to depositing them in the depressions, there is a polymeric binder material, generally gelatin, also present. It is preferred that the binder to silver ratio be relatively low, since an excessive amount of binder such as gelatin may slow or inhibit the subsequent single grain formation. In addition, excessive binder would occupy space in the depressions that could be taken by silver halide grains. Preferably, the gel to silver ratio is about 0.10 or less and more preferably about 0.075. It is also preferred that the fine-grain emulsion be dried in the depressions prior to the next processing step so that subsequent processing steps will not result in the displacement or loss of the fine-grain silver halide emulsion from the depressions.

It is also preferred that surfactants be employed to facilitate coating of the emulsion in the depressions. In a preferred embodiment, the surfactants comprise a combination of AEROSOL OT (dioctyl ester of sodium sulfosuccinic acid) American Cyanamid Co., Wayne, N.J., and MIRANOL J2M-SF (dicarboxylic caprylic derivative sodium salt) Miranol Chemical Co., Inc., Irvington, N.J., in a 1 to 3 ratio by weight, respectively, at about a 0.1% concentration by weight, based on the weight of the emulsion.

The fine-grain emulsion added to the silver halide solvent solution is chemically sensitized by conventional methods employing conventional chemical sensitizers. The thus-sensitized emulsion is then added to the coalescing fluid, i.e., a solution of a silver halide solvent and applied to the fine-grain emulsion in the depressions of a support during lamination. Photographic evaluation of the thus-formed single effective grains shows a significant photographic speed increase, in some cases as much as a factor of ten.

The composition of fine-grain emulsion which is chemically sensitized and mixed with silver halide solvent is not critical and may comprise any mixture of silver halides which is employed in conventional emulsions. The specific grain size is also not critical, so long as the grains are compatible with the chemical sensitization and lamination processes. It should be understood that the sensitized grains are smaller than the depressions. The chemically sensitized fine grains are significantly slower photographically than the resulting chemically sensitized single effective silver halide grains in the depressions.

The amount of silver halide added to the resulting layer of single effective grains is not a significant fraction of the total amount of silver halide present. Generally, the chemically sensitized fine grain emulsion is only about 5% or less of the total silver halide present.

Since many of the chemical sensitizing materials are also silver halide solvents, e.g., thiosulfate and thiocyanate, some grain growth may occur during chemical sensitization of the fine grain emulsion to prepare the preformed sensitivity centers, but care should be taken to ensure that the grain size does not increase too much, i.e., it should be sufficiently small to be incorporated with the silver halide in the depressions.

Alternatively, the fine grain silver halide emulsion in the depressions is coalesced into a single effective grain in each depression by the application of a coalescing amount of silver halide solvent solution, by melting or by contact with the vapor of a silver halide solvent. Subsequent to coalescence, the thus-formed single effective grains are contacted with a chemically sensitized fine-grain emulsion and silver halide solvent.

The chemical sensitizing agents are not critical and chemical sensitizing agents known to the art may be employed provided they are not incompatible with the coalescing fluid. As examples of such sensitizing agents mention may be made of sulfur, selenium, and tellurium compounds, noble metal compounds, such as gold, palladium or platinum compounds or combinations of them. With regard to the use of such chemical sensitizing agents mention may be made of U.S. Pat. Nos. 1,574,944; 1,623,499; 2,410,689; 2,597,856; 2,597,915; 2,487,850; 2,518,698; 2,521,926; and the like, as well as Neblette, C. B., *Photography: Its Materials and Processes,* 6th Ed., 1962. Reduction sensitization with stannous chloride or other compatible reducing agents may also be employed.

The following non-limiting examples illustrate the novel process of the present invention.

EXAMPLE 1

(Control)

A fine-grain silver iodobromide emulsion (4 mole % I, gelatin/Ag ratio of 0.075, grain diameter 0.1 μm) was coated onto a polyester base carrying a layer of cellulose acetate butyrate embossed with depressions about 1.8 μm in diameter, depth about 1 μm with center-to-center spacing of 2.2 μm to provide a silver coverage of 75 mg/ft$^2$. The emulsion contained a 1 to 3 ratio, by weight, of AEROSOL OT (dioctyl ester of sodium sulfosuccinic acid, American Cyanamid, Wayne, N.J.) and MIRANOL J2M-SF, (dicarboxylic caprylic derivative sodium salt, Miranol Chemical Co., Irvington, N.J.), respectively, at a 0.1% concentration, by weight, based on the weight of the emulsion, to facilitate coating. The emulsion-coated embossed base was then dried.

The coalescing fluid comprised 4.5% (w/w) of ammonium thiocyanate and 1% (w/w) inert gelatin.

The emulsion-coated embossed base was overlaid with a cover sheet comprising a layer of non-embossed cellulose acetate butyrate on a polyester support and passed through rubber rollers with pressure applied thereto while the coalescing fluid was applied to the nip formed by the emulsion-coated embossed base and the cellulose acetate butyrate cover sheet.

The thus-formed lamination was contacted with a metal drum at 95° C. for 15 sec and then cooled to room temperature and the cover sheet was detached from the embossed base.

The thus-formed spaced array of single effective grains was then exposed to a step tablet and a continuous wedge at 2 mcs and processed with a Type 42 processing composition and Type 107C receiving sheet (Polaroid Corp., Cambridge, MA).

EXAMPLE 2

(Control)

A fine-grain silver iodobromide emulsion (4 mole % I, gelatin/Ag ratio of 0.075, grain diameter 0.1 μm) was coated onto a polyester base carrying a layer of cellulose acetate butyrate embossed with depressions 1.8 μm in diameter, depth about 1 μm with center-to-center spacing of 2.2 μm to provide a silver coverage of 75 mg/ft$^2$. The emulsion contained a 1 to 3 ratio, by weight, of AEROSOL OT (dioctyl ester of sodium sulfosuccinic acid, American Cyanamid, Wayne, N.J.) and MIRANOL J2M-SF, (dicarboxylic caprylic derivative sodium salt, Miranol Chemical Co., Irvington, N.J.), respectively, at a 0.1% concentration, by weight, based on the weight of the emulsion, to facilitate coating. The emulsion-coated embossed base was then dried.

The coalescing fluid was prepared by combining equal volumes of a gold/sulfur sensitizing solution and a 9% (w/w) solution of ammonium thiocyanate. The gold/sulfur sensitizing solution was prepared by adding to a 50 cc solution of 2% inert gelatin, 2.28 cc of a 0.1% sodium thiosulfate solution, 2.85 cc of a solution prepared from 3 g of $HAuCl_4.3H_2O$ (4909 ppm Au) and 25 g of ammonium thiocyanate. The coalescing fluid was used immediately after makeup.

The emulsion-coated embossed base was overlaid with a cover sheet comprising a layer of non-embossed cellulose acetate butyrate on a polyester support and passed through rubber rollers with pressure applied thereto while the above-described coalescing fluid was applied to the nip formed by the emulsion-coated embossed base and the cellulose acetate butyrate cover sheet.

The thus-formed lamination was contacted with a metal drum at 95° C. for 15 sec and then cooled to room temperature and the cover sheet was detached from the embossed base.

The thus-formed array of single effective grains was then exposed to a step tablet and continuous wedge at 2 mcs and processed with a Type 42 processing composition and Type 107C receiving sheet (Polaroid Corp., Cambridge, MA).

The step tablets and continuous wedges obtained in Examples 1 and 2 showed that employment of the chemical sensitizers in Example 2 resulted in desensitization compared to Example 1 (no chemical sensitization), rather than the desired sensitization.

EXAMPLE 3

A fine-grain silver iodobromide emulsion (4 mole % I, gelatin/Ag ratio of 0.075, grain diameter 0.1 μm) was coated onto a polyester base carrying a layer of cellulose acetate butyrate embossed with depressions 1.8 μm in diameter, depth about 1 μm with center-to-center spacing of 2.2 μm to provide a silver coverage of 84 mg/ft$^2$. The emulsion contained a 1 to 3 ratio, by weight, of AEROSOL OT (dioctyl ester of sodium sulfosuccinic acid, American Cyanamid, Wayne, N.J.) and MIRANOL J2M-SF, (dicarboxylic caprylic derivative sodium salt, Miranol Chemical Co., Irvington, N.J.), respectively, at a 0.1% concentration, by weight, based on the weight of the emulsion, to facilitate coating. The emulsion-coated embossed base was then dried.

To a separate 40 cc aliquot of the fine-grain emulsion described above (4% Ag) was added 2.28 cc of a 0.1% solution of sodium thiosulfate; 2.85 cc of a solution prepared from 3 g of $HAuCl_4.3H_2O$ (4909 ppm Au) and 25 g of a 1% solution of ammonium thiocyanate; and 10 cc of a 10% solution of inert gelatin. The mixture was heated to 54° C. for 90 min with stirring. Electrolytic Grain Size Analysis showed very little grain growth at the end of the sensitization period.

The coalescence fluid was prepared by combining equal volumes of the thus-chemically sensitized emulsion and a 9% solution of the ammonium thiocyanate. The coalescing fluid was used immediately after combining the chemically sensitized emulsion and the silver halide solvent solution. The gold, sulfur and thiocyanate concentrations in the coalescence fluid were the same as in the coalescence fluid in Example 2.

The emulsion-coated embossed base was overlaid with a cover sheet comprising a layer of non-embossed cellulose acetate butyrate on a polyester support and passed through rubber rollers with pressure applied thereto while the above-described coalescing fluid was applied to the nip formed by the emulsion-coated embossed base and the cellulose acetate butyrate cover sheet.

The thus-formed lamination was contacted with a metal drum at 95° C. for 30 sec and then cooled to room temperature and the cover sheet was detached from the embossed base.

The thus-formed array of single effective grains was then exposed to a step tablet and continuous wedge at 2 mcs and processed with a Type 42 processing composition and Type 107C receiving sheet (Polaroid Corp., Cambridge, MA). The FIGURE shows H&D curves obtained from a recording densitometer showing the photographic response in terms of the positive image obtained in Example 3 and the positive image obtained in the same manner as Example 3 except that no chemical sensitization was employed in the fine-grain emulsion in the coalescing fluid. It will be noted that not only was about a 10-fold increase in photographic speed obtained with the element prepared according to this invention (Example 3) but the dynamic range was also increased.

A comparison of the elements of Example 3 and Example 2 demonstrates the criticality of employing preformed sensitivity centers rather than a gold and sulfur solution. Employing the same level of sensitizers in each Example and under the same conditions resulted in desensitization in Example 2 and a difference in sensitivity of about 6 stops between Example 3 and Example 2.

The quantity of fine-grain emulsion employed with the silver halide solvent is not critical and can vary over a wide range without adverse effect. However, the amount of chemical sensitizer which is added to the fine-grain emulsion to provide the preformed sensitivity centers must be sufficient to provide increased photographic speed but not in a level that would result in desensitization.

It has been found that it is critical that the chemically sensitized silver halide emulsion be added to the silver halide in the depressions with silver halide solvent. For example, using a chemically sensitized fine-grain emulsion as the fine-grain emulsion that is coated in the depressions in the embossed base did not provide the desired increase in speed in the thus-formed single effective grains. Similarly, depositing a small amount of the chemically sensitized fine-grain emulsion in the depressions and then overcoating with unsensitized fine-grain emulsion and then coalescing also did not provide the speed increase obtained by the present invention.

Spectral sensitization may be carried out by applying a solution of a spectral sensitizing dye prior to or subsequent to the formation of the single effective grains.

Subsequent to formation of the single effective grains, the grains may be transferred to a hydrophilic colloid layer according to the procedure of U.S. Pat. No. 4,353,977.

Additional optional additives, such as coating aids, hardeners, viscosity-increasing agents, stabilizers, preservatives, and the like may also be employed in the present invention.

We claim:

1. A method for forming a photosensitive element which comprises contacting silver halide in a plurality of spaced depressions in a surface with a mixture of a silver halide solvent and a chemically sensitized fine-grain silver halide emulsion, thereby forming a chemically sensitized single effective silver halide grain in substantially each depression.

2. The method of claim 1 wherein said silver halide in each of said depressions is a single effective grain.

3. The method of claim 1 wherein said silver halide in each of said depressions is a single effective grain.

4. The method of claim 1 wherein said silver halide in said depressions is contacted with a coalescing amount of silver halide solvent solution and the thus-formed single effective grains are then contacted with a mixture of said chemically sensitized fine-grain silver halide emulsion and silver halide solvent.

5. The method of claim 1 wherein said silver halide in said depressions is contacted substantially contemporaneously with a coalescing amount of silver halide solvent and said chemically sensitized fine-grain silver halide emulsion.

6. The method of claim 1 wherein the grains of said chemically sensitized fine-grain silver halide emulsion are substantially the same size as said silver halide in said depressions.

7. The method of claim 6 wherein said silver halide in said depressions comprises a fine-grain silver halide emulsion having silver halide grains about 0.01 to 0.50 μm in diameter.

8. The method of claim 7 wherein said fine-grain silver halide emulsion consists of grains about 0.1 μm or less in diameter.

9. The method of claim 7 wherein said fine-grain silver halide emulsion has a binder to silver ratio of about 0.10 or less.

10. The method of claim 7 wherein said binder to silver ratio is about 0.075.

11. The method of claim 1 wherein said silver halide solvent is ammonium thiocyanate.

12. The method of claim 1 wherein said silver halide solvent is a solution containing both ammonium thiocyanate and potassium bromide.

13. The method of claim 1 wherein said chemically sensitized fine-grain silver halide emulsion is sensitized with sulfur and gold.

14. The method of claim 1 wherein said silver halide solvent includes a solution of a polymeric binder material.

15. The method of claim 14 wherein said polymeric binder material is gelatin.

16. The method of claim 4 wherein said silver halide is contacted with said coalescing amount of silver halide solvent solution with the application of heat.

17. The method of claim 16 which includes the step of cooling subsequent to said application of heat.

18. A method for forming a photosensitive element comprising a plurality of single effective silver halide grains in a spaced array which comprises the following steps in sequence:

(a) depositing a fine-grain silver halide emulsion in a plurality of spaced depressions in a surface;

(b) applying a solution of silver halide solvent containing a chemically sensitized fine-grain silver halide emulsion to said fine-grain silver halide emulsion in each depression; and (c) coalescing said silver halide grains to a chemically sensitized single effective silver halide grain in substantially each depression.

19. The method of claim 18 which includes the step of applying a cover sheet over said depressions substantially contemporaneously with the application of said solution of silver halide solvent.

20. The method of claim 19 wherein said solution of silver halide solvent is disposed in a nip formed by a cover sheet and said depressions and applying pressure to said cover sheet and the element comprising said depressions.

21. The method of claim 20 wherein said pressure is applied by passing said cover sheet and the element comprising said depressions between pressure applying rollers.

22. The method of claim 18 wherein said coalescence includes the application of heat.

23. The method of claim 22 which includes the step of cooling subsequent to said application of heat.

24. The method of claim 19 wherein said cover sheet is removed subsequent to said coalescence.

25. The method of claim 18 wherein said chemically sensitized fine-grain silver halide emulsion is substantially the same size as said fine-grain silver halide emulsion.

26. The method of claim 18 wherein said fine-grain silver halide emulsion comprises silver halide grains about 0.01 to 0.50 μm in diameter.

27. The method of claim 26 wherein said fine-grain silver halide emulsion comprises grains about 0.1 μm or less in diameter.

28. The method of claim 18 wherein said fine-grain silver halide emulsion has a binder to silver ratio of about 0.10 or less.

29. The method of claim 28 wherein said binder to silver ratio is about 0.075.

30. The method of claim 18 wherein said silver halide solvent is ammonium thiocyanate.

31. The method of claim 18 wherein said silver halide solvent of a solution containing both ammonium thiocyanate and potassium bromide.

32. The method of claim 18 wherein said chemically sensitized fine-grain silver halide emulsion is sensitized with sulfur and gold.

33. The method of claim 1 wherein said chemically sensitized silver halide emulsion consists of not more than 5% of the total silver halide.

* * * * *